US007368079B2

(12) United States Patent
Yao et al.

(10) Patent No.: US 7,368,079 B2
(45) Date of Patent: May 6, 2008

(54) METHOD FOR FORMING ULTRA HARD SINTERED COMPACTS USING METALLIC PERIPHERAL STRUCTURES IN THE SINTERING CELL

(75) Inventors: Xian Yao, Sandy, UT (US); David DenBoer, Pleasant Grove, UT (US); Scott Horman, Lindon, UT (US)

(73) Assignee: Smith International, Inc., Houston, TX (US)

( * ) Notice: Subject to any disclaimer, the term of this patent is extended or adjusted under 35 U.S.C. 154(b) by 156 days.

(21) Appl. No.: 10/731,710

(22) Filed: Dec. 9, 2003

(65) Prior Publication Data

US 2005/0123430 A1 Jun. 9, 2005

(51) Int. Cl.
*B22F 7/00* (2006.01)

(52) U.S. Cl. ..... 419/6; 51/293; 51/307; 51/309; 175/374; 175/432; 428/551; 428/552

(58) Field of Classification Search ..... 419/1–8, 419/18, 11; 51/295, 307–309; 175/374, 175/430

See application file for complete search history.

(56) References Cited

U.S. PATENT DOCUMENTS 3,679,807 A * 7/1972 Carcey ..... 373/151
3,745,623 A * 7/1973 Wentorf et al. ..... 407/119
3,831,428 A * 8/1974 Wentorf et al. ..... 72/467
3,913,280 A * 10/1975 Hall ..... 51/307
4,016,736 A * 4/1977 Carrison et al. ..... 72/41
4,224,380 A * 9/1980 Bovenkerk et al. ..... 428/545
4,241,135 A * 12/1980 Lee et al. ..... 428/332
4,259,090 A 3/1981 Bovenkerk
4,260,397 A * 4/1981 Bovenkerk ..... 51/307
4,311,490 A * 1/1982 Bovenkerk et al. ..... 51/307
4,414,028 A * 11/1983 Inoue ..... 419/31
4,470,953 A * 9/1984 Bruce ..... 419/6
4,525,179 A * 6/1985 Gigl ..... 51/309
4,534,934 A * 8/1985 Cho ..... 419/6
4,702,649 A 10/1987 Komanduri
4,762,445 A * 8/1988 Bunting et al. ..... 408/144
4,797,326 A * 1/1989 Csillag ..... 428/552
4,944,772 A * 7/1990 Cho ..... 51/293
4,997,049 A 3/1991 Tank et al.
5,159,857 A * 11/1992 Jurewicz ..... 76/108.2
5,173,090 A 12/1992 Scott et al.
5,492,188 A * 2/1996 Smith et al. ..... 175/432
5,603,070 A * 2/1997 Cerutti et al. ..... 419/6
5,848,348 A * 12/1998 Dennis ..... 419/5
6,220,375 B1 * 4/2001 Butcher et al. ..... 175/428
6,227,318 B1 * 5/2001 Siracki ..... 175/430
6,439,327 B1 * 8/2002 Griffin et al. ..... 175/434

FOREIGN PATENT DOCUMENTS

WO WO03/083148 A1 * 10/2003

* cited by examiner

*Primary Examiner*—Hoy King
*Assistant Examiner*—Weiping Zhu
(74) *Attorney, Agent, or Firm*—Christie, Parker & Hale, LLP.

(57) ABSTRACT

A method for forming an ultra hard material layer is provided. The method includes disposing a metallic liner inside the periphery of a refractory metal enclosure, introducing ultra hard material feed stock into the enclosure, and sintering using HPHT processing and cooling to form the ultra hard material layer, substantially free of peripheral cracking, chipping and fracturing.

34 Claims, 6 Drawing Sheets

METHOD FOR FORMING ULTRA HARD SINTERED COMPACTS USING METALLIC PERIPHERAL STRUCTURES IN THE SINTERING CELL

BACKGROUND OF THE INVENTION

Sintered ultra hard material cutting elements such as tips for metal machining inserts, for example, typically include an ultra hard cutting layer bonded to a substrate, forming what is often referred to as a compact. The ultra hard cutting layer is generally formed by a high pressure, high temperature (HPHT) sintering process and the cutting layer is typically bonded to the substrate during the sintering process.

The ultra hard sintered compact is generally formed from particles of ultra hard material that are compacted and solidified during the sintering process. The ultra hard particles may be in powder form prior to sintering. Ultra hard particles used to form sintered compacts include diamond and cubic boron nitride, which form polycrystalline diamond (PCD) and polycrystalline cubic boron nitride (PCBN), respectively.

Sintered compacts are conventionally formed by placing ultra hard material particles within a refractory metal enclosure and sintering the enclosure and contents under HPHT conditions. A shortcoming associated with this conventional formation process is that the high-pressure, high temperature heating process and subsequent cooling process, produce an ultra hard material layer having a periphery that includes edge cracks, chips and fractures. These edge cracks, chips and fractures typically initiate at the enclosure and continue growing into to the compact ultra hard material layer. This cracking, chipping, fracturing, etc. renders the outer portion of the ultra hard material layer unusable. Fracturing, cracking, and chipping is especially prevalent when forming relatively large (more than 50 mm diameter) ultra hard material layers. To avoid sintered compacts being delivered to customers having peripheries that include the above-mentioned defects, a significant amount of the outer portions of the PCD or PCBN sintered compacts must be removed, therefore reducing the useable diameter of the sintered compacts. This results in higher raw material waste and costs, higher processing costs, and lower HPHT press capacity efficiency and utilization. For example, using conventional methods, a disk-shaped sintered compact formed to a diameter of 58 mm, may include edge fracturing and cracking that requires the formed sintered compact to have parts of the peripheral portion removed resulting in a useable diameter of only 50-52 mm or less. In particular, according to the prior art, most sintered compacts formed to a diameter of 58 millimeters, for example, are finished to a diameter less than 55 mm.

Accordingly, it would therefore be desirable to produce an ultra hard cutting layer in which the high quality, useable cutting area is maximized.

SUMMARY OF THE INVENTION

To address the aforementioned concerns and in view of its purposes, the present invention provides an exemplary method for forming an ultra hard layer or a compact. The method includes providing a refractory metal enclosure having an inner wall, disposing a metallic liner within the enclosure, disposing ultra hard material particles within the enclosure, and sintering to convert the ultra hard material particles to a solid ultra hard layer that may be used as a cutting layer.

In another exemplary embodiment, a method is provided for forming an ultra hard layer or a compact, including providing a refractory metal enclosure having an inner wall and disposing a liner within said enclosure. The method further requires placing ultra hard material feed stock within the enclosure, placing a substrate material within the enclosure over the feed stock layer, and sintering to convert the ultra hard material feed stock to a solid ultra hard layer, where a melting temperature of a eutectic formed during sintering between the liner, a compound of the ultra hard material and the enclosure is in the range of about 1100° to 1410° C.

In a further exemplary embodiment, a method is provided for forming an ultra hard layer, including providing a refractory metal enclosure having an inner wall, and disposing a liner within said enclosure, the liner having a melting temperature lower than the enclosure. The method also requires placing ultra hard material feed stock within said enclosure, and sintering to convert said ultra hard material feed stock to a solid ultra hard layer.

BRIEF DESCRIPTION OF THE DRAWINGS

The invention is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity. Like numerals denote like features throughout the specification and drawings. Included are the following figures.

DETAILED DESCRIPTION OF THE INVENTION

The present invention provides in an exemplary embodiment, a method for producing an ultra hard material sintered layer or compact with a peripheral edge substantially free of fracturing, cracking and chipping. The exemplary method includes providing a refractory metal enclosure and providing a metallic liner, coating or layer (collectively or individually referred to as metallic liner hereinafter) within the enclosure. Particles of ultra hard material such as an ultra hard material feed stock are introduced into the enclosure and the material is then sintered using HPHT processing.

Figure 1:
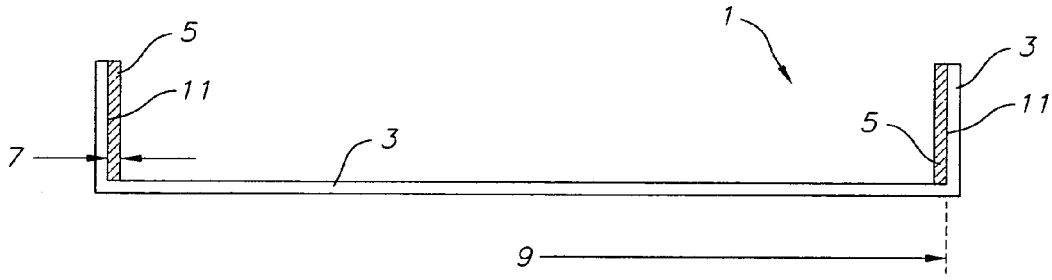
FIG. 1 is a cross-sectional view showing an exemplary refractory metal enclosure including a peripheral metallic liner therein.

FIG. 1 is a cross-sectional view showing enclosure 1 formed of refractory metal material 3. Enclosure 1 may be alternatively referred to as a can or a cell. Enclosure 1 includes inner wall 11 and, in an exemplary embodiment may be cylindrical. In such an embodiment, the inner wall 11 may be a single continuous inner peripheral wall that is cylindrical in shape. For illustrative purposes, enclosure 1 will be discussed in terms of being generally cylindrical and having an inner peripheral wall 11, but it should be understood that such is exemplary only and in other exemplary embodiments, enclosure 1 may take on various different shapes and may include a plurality of inner walls which may take on various configurations. For example, enclosure 1 may take on other shapes such as elliptical or oblong shapes, or other parabolic or rectilinear shapes. Refractory metal material 3 forming enclosure may be niobium, Nb, tantalum, Ta, molybdenum, Mo, or another suitable refractory metal material as for example a member of the IVB, VB, and VIB families of the periodic table. Within enclosure 1 and adjacent inner peripheral wall 11 in the illustrated exemplary embodiment is placed metallic liner 5. In an exemplary embodiment, the metallic liner 5 has a melting temperature lower than the melting temperature of enclosure 1. Metallic liner 5 may be formed of cobalt, Co, nickel, Ni, iron, Fe, steel, or alloys of the aforementioned materials. In one exemplary embodiment, an 95:5 cobalt-iron metallic liner 5 may be used. Such materials are intended to be exemplary only and in other exemplary embodiments, other suitable metallic materials may be used to form metallic liner 5. Metallic liner 5 includes thickness 7 which may be within the range of 0.005 mm to 3 mm in an exemplary embodiment, but other suitable thicknesses may be used in other exemplary. embodiments. Although metallic liner 5 is shown adjacent inner peripheral wall 11 it should be understood that metallic liner 5 may be spaced from inner peripheral wall 11 prior to the introduction of the particles of ultra hard material (as will be shown later). Enclosure 1 has an inner diameter 9 defined by inner peripheral wall 11 and in an exemplary embodiment, inner diameter 9 may range from 40-80 mm. In one particular exemplary embodiment, inner diameter 9 may lie within the range of 55-60 mm.

Figure 2:
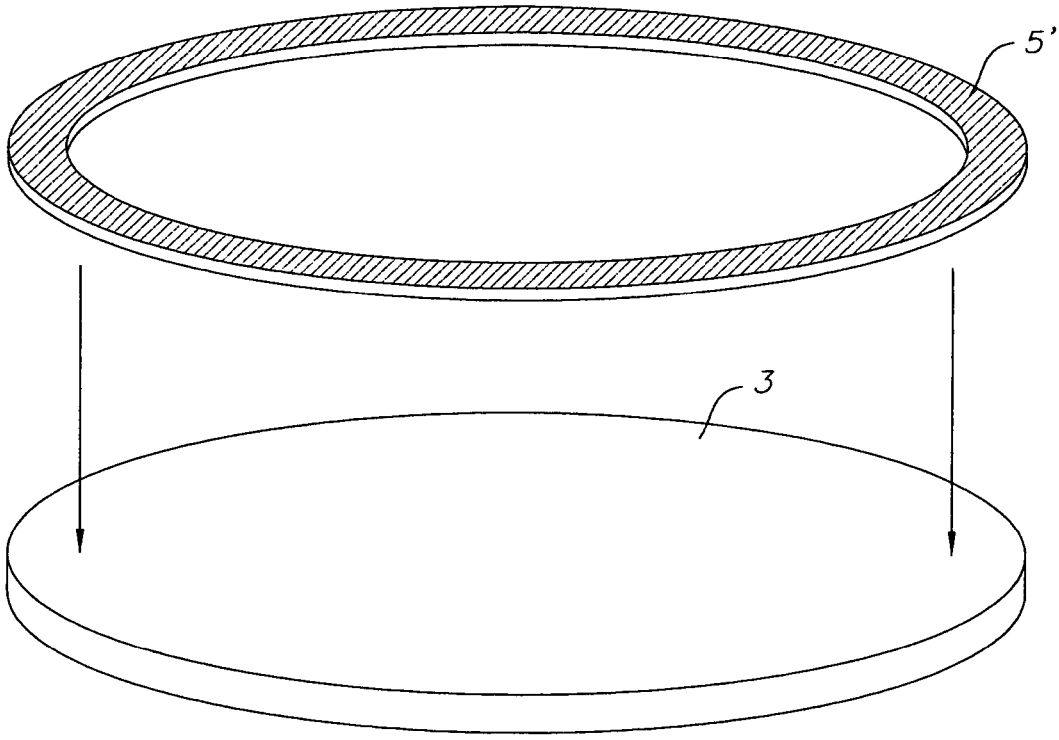
FIG. 2 is a perspective view showing a liner ring and a refractory metal disc prior to being shaped into an enclosure.
Figure 3:
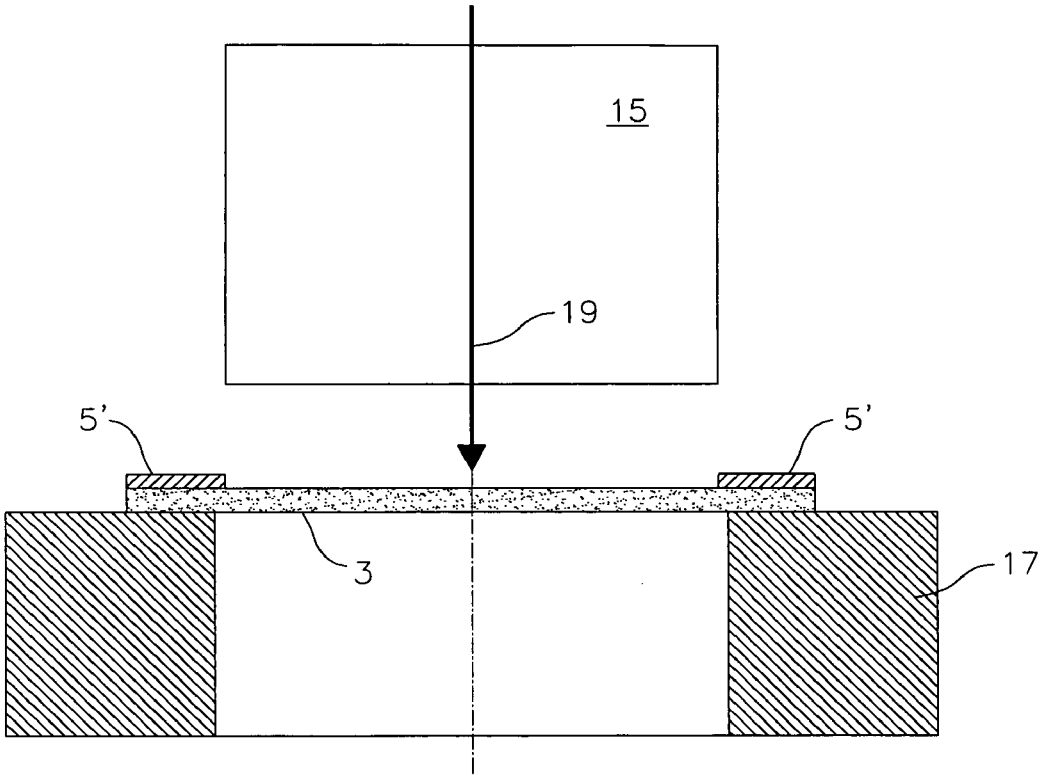
FIG. 3 is a cross-sectional view showing a punch and die used to punch the components shown in FIG. 2, into a refractory metal enclosure with the metallic liner therein.

Metallic liner 5 may be positioned within enclosure 1 using various mechanical techniques. In one exemplary embodiment, metallic liner 5 may simply be placed within enclosure 1 by hand or using other manual techniques. For example, the metallic liner may be a layer of metallic material applied using various well known methods, such as spraying or brushing. In another exemplary embodiment, the metallic liner and enclosure may be shaped and arranged simultaneously using metal drawing techniques. For example, as shown in FIG. 2, a metallic liner 5' having a generally annular shape, is placed over a substantially flat disk of refractory metal material 3, and then mechanically shaped to form the enclosure 1/metallic liner 5 arrangement shown in FIG. 1 by being positioned in the punch/die arrangement shown in FIG. 3, then punched. According to the cross-sectional schematic shown in FIG. 3, punch 15 moves in direction 19 to force the disk of refractory metal material 3 and metallic liner 5' into die 17 thereby shaping the refractory metal material 3 and the annular shaped metallic liner 5' generally into the configuration shown in FIG. 1 where enclosure 1 is lined with metallic liner 5.

Figure 4:
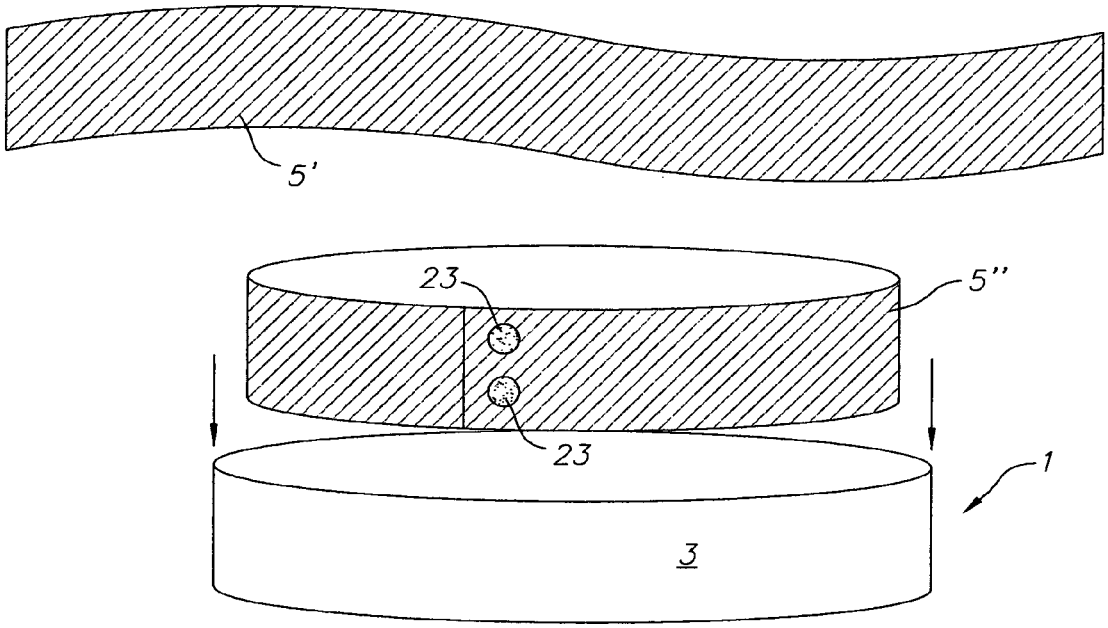
FIG. 4 is a perspective view showing another exemplary arrangement for positioning a metallic liner ring within an enclosure.

FIG. 4 is a perspective view showing another exemplary embodiment for forming enclosure 1 of refractory metal material 3 and including metallic liner 5 therein, as shown in FIG. 1. According to the embodiment shown in FIG. 4, enclosure 1, formed of refractory metal material 3, is pre-formed and a strip of liner 5" is formed in a cylindrical shape and inserted within pre-formed enclosure 1. In one exemplary embodiment, after the strip of metallic liner 5" is arranged in a cylindrical shape, it is then spot welded such as at spot weld points 23, to connect its respective opposed ends. Other techniques for forming a generally cylindrical metallic liner 5" and for positioning the same within enclosure 1, may be used in other exemplary embodiments.

Figure 5:
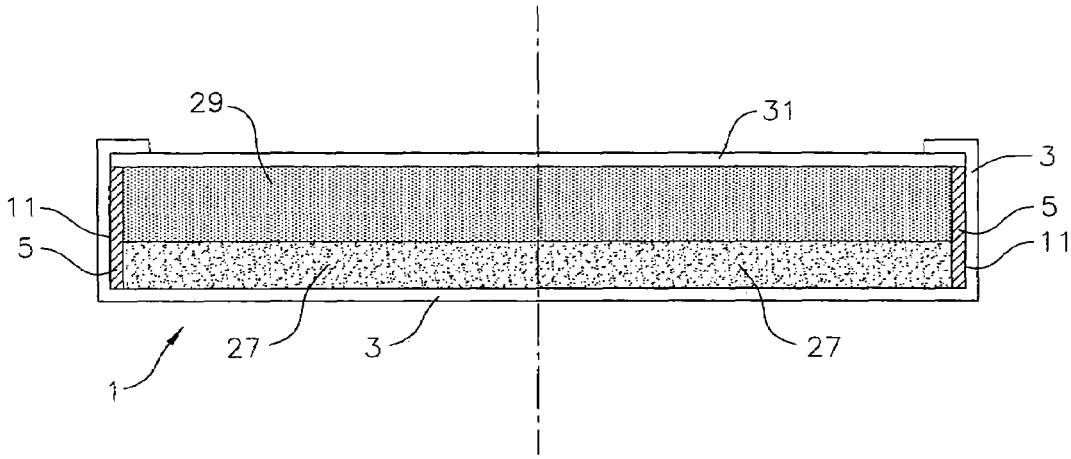
FIG. 5 is a cross sectional view showing a substrate and ultra hard particles within an enclosure.

FIG. 5 shows exemplary enclosure 1, previously shown in FIG. 1, after particles of ultra hard material and a substrate 29 have been introduced into enclosure 1. Particles of ultra hard material 27 are added to enclosure 1 and may be in powder form. Particles of ultra hard material 27 may be cubic boron nitride or diamond feed stocks for forming sintered PCD or PCBN of various compositions. In the exemplary embodiment illustrated in FIG. 5, substrate 29 is also disposed within enclosure 1. Substrate 29 may be formed of WC—Co or WC—Ni or other suitable materials. In other exemplary embodiments, substrate 29 is not added within enclosure 1, thus, a mono-block product, such as an ultra hard layer is formed. According to such exemplary embodiment, after the particles of ultra hard material 27 are sintered using an HPHT process to form an ultra hard layer, the ultra hard layer may be used as a cutting layer or joined to a separately formed substrate to form a cutting element.

It can be seen in the illustrated exemplary embodiment that metallic liner 5 is adjacent inner peripheral wall 11 of enclosure 1, and interposed between inner peripheral wall 11 and particles of ultra hard material 27. In this manner, peripheral portions of the layer of particles of ultra hard material 27, as well as substrate 29, contact metallic liner 5 and do not contact inner peripheral walls 11 of the enclosure directly. In an exemplary embodiment, after the materials are introduced into enclosure 1, the enclosure is covered by a refractory metal cover 31 as shown in FIG. 5, and enclosure 1 and its contents are sintered using HPHT processing. In the illustrated exemplary embodiment, refractory metal cover 31 is formed from the same material as enclosure 1. Conventional HPHT pressing techniques may be used. In one exemplary embodiment, the sintering process may utilize heating to a temperature within the range of 1200-1600° C. and using a pressure of up to 40-65 kilobars. After the sintering process, the enclosure and its contents are cooled and the pressure is reduced to ambient conditions.

During the sintering and cooling processes, the layer of particles of ultra hard material 27 is sintered and thereby converted to a polycrystalline ultra hard material layer. According to the embodiments in which substrate 29 is present in the enclosure, the sintering process bonds the formed ultra hard layer to substrate 29. During the sintering process, the metallic material that forms metallic liner 5, and which contacts particles of ultra hard material 27, in particular around the periphery, forms a molten alloy region which becomes a plastically deformable region during the cooling stage following HPHT sintering.

During the HPHT sintering, materials from metallic liner 5 may infiltrate peripheral portions of the layer of particles of ultra hard material 27. The metallic liner is in the exemplary embodiment chosen to posses similar melting/solidifying temperatures as the substrate materials, therefore alleviating the stresses on the periphery. The ferrous family of metals forming the liner are chosen to form liquid eutectics which solidify at temperatures very similar to the liquid eutectic temperatures found in the substrate material. In an exemplary embodiment, no more than about the outer 500 micron peripheral portion of the ultra hard material may be so infiltrated. Applicants have discovered that the HPHT sintering and cooling processes convert the layer of particles of ultra hard material 27 to a solid polycrystalline ultra hard layer that is substantially or completely free of cracks, chips, fractures and other defects substantially throughout the formed sintered compact.

In conventional HPHT sintering of PCD and PCBN in refractory metal enclosures made of Nb or Ta, the melting temperatures of the binary compounds formed are typically greater than 1770° C. For example when sintering cubic boron nitride in a Nb enclosure an Nb—B and/or Nb—N binary system is formed with no eutectic. When sintering diamond in a Nb enclosure an Nb—C binary is formed with no eutectic. When sintering cubic boron nitride in a Ta enclosure, a binary system Ta—B may be formed having a eutectic having a melting temperature of about 1770° C. or a Ta—N binary system is formed having no eutectic. If diamond is sintered in a Ta enclosure a Ta—C binary system may be formed having a eutectic having a melting temperature of about 2800° C.

When using a Co, Ni, or Fe liner in a Nb or Ta enclosure during sintering, binary systems are formed having eutectics having melting eutectic temperatures as shown in Tables 1 and 2, respectively, below.

TABLE 1

Eutectic Melting Temperatures in an Nb enclosure.

| Binary System | Eutectic Melting Temperature, ° C. |
|---|---|
| Nb—Co | 1235 |
| Nb—Ni | 1270 |
| Nb—Fe | 1360 |

TABLE 2

Eutectic Melting Temperatures in a Ta enclosure.

| Binary System | Eutectic Melting Temperature, ° C. |
|---|---|
| Ta—Co | 1276 |
| Ta—Ni | 1360 |
| Ta—Fe | 1410 |

When sintering cubic boron nitride or diamond in an enclosure lined with a Co, Ni, or Fe liner, binary systems are formed having eutectics having the melting temperatures as shown in Tables, 3 and 4, respectively.

TABLE 3

Eutectic Melting Temperatures of Binary Systems formed during Sintering of CBN in Metallic Liners

| Binary System | Eutectic Melting Temperature, ° C. |
|---|---|
| B—Co | 1102 |
| B—Ni | 1140 |
| B—Fe | 1149 |
| N—Co | N almost non soluble in Co |
| N—Ni | N almost non soluble in Ni |
| N—Fe | 2.8 wt % N soluble in Fe at 650 C. |

TABLE 4

Eutectic Melting Temperatures of Binary Systems formed during Sintering of diamond in Metallic Liners

| Binary System | Eutectic Melting Temperature, ° C. |
|---|---|
| C—Co | 1309 |
| C—Ni | 1318 |

TABLE 4-continued

Eutectic Melting Temperatures of Binary Systems formed during Sintering of diamond in Metallic Liners

| Binary System | Eutectic Melting Temperature, ° C. |
|---|---|
| C—Fe | 1153 |

As can be seen the eutectics formed between the liner and the enclosure and between the enclosure and the diamond of cubic boron nitride have a melting temperature from around 1102° C. to 1410° C. and as such are much closer to the substrate (WC—Co) eutectic melting temperature of about 1320° C. then are the melting temperatures of the eutectics formed when no metallic liners are used. Consequently, these eutectics and the substrate solidify at temperatures during the cooling stage of the HPHT sintering process that are closer together than when not using the exemplary metallic liners thus reducing the stresses and consequential cracking, pitting and fracturing that is evident when sintering without the liners.

In an exemplary embodiment, the liners are chosen to form eutectics having a melting temperature within 310° C. of the eutectic melting temperature of the substrate. Moreover, the lower melting point eutectic formed via the metallic liner between the refractory metal enclosure and the cubic boron nitride or diamond, as compared with the higher melting temperature eutectics formed when no liner is used, acts as a "liquid shell" which solidifies at a similar temperature range with the substrate during the cooling stage of the HPHT sintering process, retarding and/or arresting the growth of cracks, and fractures and thus, chips, that typically initiate at the enclosure from progressing into the compact or ultra hard material. Consequently the compacts or ultra hard material layers formed using the exemplary embodiment method are substantially or completely free of cracks, fractures and chips at their ultra hard material peripheries.

In the embodiment where the ultra hard material layer is sintered without a substrate, the liner is chosen to form a eutectic with the enclosure and/or a compound of the ultra hard material having a melting temperature in the range of about 1100° C. to about 1410° C.

Figure 6:
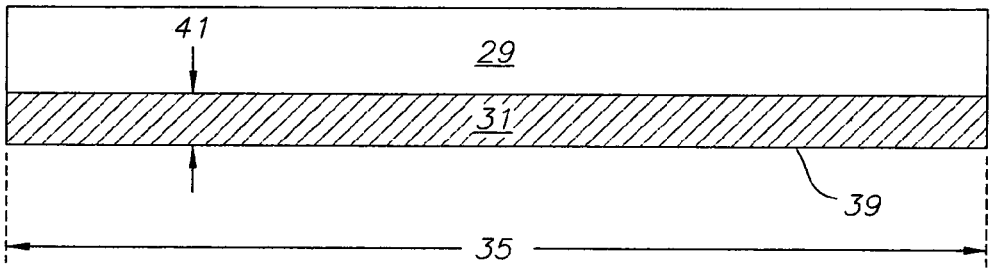
FIG. 6 is a cross-sectional view showing an ultra hard layer bonded to a substrate.

FIG. 6 shows an exemplary embodiment of an ultra hard layer 31 bonded to substrate 29 and formed using enclosure 1 and the layer of particles of ultra hard materials 27. Ultra hard layer 31 may be formed of polycrystalline cubic boron nitride (PCBN), polycrystalline diamond (PCD) or other suitable ultra hard materials. Ultra hard layer 31 includes surface 39 and diameter 35. In an exemplary embodiment, diameter 35 may range from 40-100 mm. In one particular exemplary embodiment, ultra hard layer 31 may be disk shaped and diameter 35 may be at least 55 mm, for example, it may be 58 mm.

Ultra hard layer 31 also includes thickness 41, which may be about "0.5 mm to 5 mm" in an exemplary embodiment, but various other thicknesses may be used in other exemplary embodiments. Diameter 35 of ultra hard layer 31 is substantially equal to inner diameter 9 of enclosure 1. Substantially all of the ultra hard layer 31 formed according to the present invention is free of cracks, chips, voids and fractures. Consequently, substantially the entire ultra hard layer formed using enclosure 1, is usable as an ultra hard surface such as an ultra hard cutting surface. In an exemplary embodiment the peripheral portion of ultra hard layer 31 that was infiltrated with metal materials from metallic liner 5, may be removed using well known methods. In one exemplary embodiment, less than 500 microns of the peripheral edge may be so infiltrated and removed.

In an exemplary embodiment, the invention may be used from cutting elements such as shear cutters which are mounted on a bit body.

The preceding merely illustrates the principles of the invention. It will thus be appreciated that those skilled in the art will be able to devise various arrangements which, although not explicitly described or shown herein, embody the principles of the invention and are included within its scope and spirit. For example, the ultra hard cutting layer may be formed to different shapes and different sizes. The HPHT sintering conditions and cooling conditions, as well as the thickness and placement of the metallic liner, may be varied and still lie within the scope of the invention.

Furthermore, all examples and conditional language recited herein are principally intended expressly to be only for pedagogical purposes and to aid in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and the functional equivalents thereof. Additionally, it is intended that such equivalents include both currently known equivalents and equivalents developed in the future, i.e., any elements developed that perform the same function, regardless of structure. The scope of the present invention, therefore, is not intended to be limited to the exemplary embodiments shown and described herein. Rather, the scope and spirit of the present invention is embodied by the appended claims.

What is claimed is:

1. A method for forming an ultra hard layer, comprising:
providing a refractory metal enclosure having an inner peripheral surface;
disposing a metallic liner within said enclosure;
placing ultra hard material within said enclosure, wherein at least a portion of said metallic liner is sandwiched between said ultra hard material and said inner peripheral surface;
sintering to convert said ultra hard material to a solid ultra hard material layer, having a peripheral portion infiltrated by said metallic liner; and
removing a majority said peripheral portion.

2. The method as in claim 1, wherein said refractory metal enclosure is formed of at least one of Nb, Mo, Ta, and other members of the IVB, VB and VIB families of the periodic table.

3. The method as in claim 1, wherein said metallic liner is formed of at least one of Fe, Co, and Ni.

4. The method as in claim 1, wherein disposing comprises forming an annular surface with the metallic liner and disposing said annular surface adjacent to the inner peripheral surface.

5. The method as recited in claim 4 wherein forming said annular surface comprises forming said annular surface by punching said metallic liner.

6. The method as in claim 1, wherein disposing a metallic liner comprises disposing the metallic liner adjacent said inner peripheral surface, wherein said liner defines an annular surface surrounding said ultra hard material.

7. The method as in claim 1, further comprising disposing a substrate material within said enclosure such that said sintering bonds said substrate to said ultra hard material layer.

8. The method as in claim 7 during sintering the liner and at least a compound of the ultra hard material form a eutectic having a melting temperature lower than a melting temperature of a eutectic of the substrate material.

9. The method as in claim 7 during sintering the liner and at least a compound of the ultra hard material and the enclosure form a eutectic having a melting temperature about the same as that of a eutectic the substrate material.

10. The method as in claim 7 during sintering the liner and at least a compound of the ultra hard material and the enclosure form a eutectic having a melting temperature in the range of about 1100° C. to about 1410° C.

11. The method as in claim 1, wherein said disposing ultra hard material comprises disposing diamond material within said enclosure.

12. The method as in claim 1, wherein said disposing ultra hard material comprises disposing cubic boron nitride material within said enclosure.

13. The method as in claim 1, wherein said solid ultra hard layer includes a peripheral edge, said metallic liner includes a metallic material and said sintering causes said metallic material to infiltrate a portion of said ultra hard layer extending no further than 500 microns inward from said peripheral edge.

14. The method as in claim 1, wherein said sintering produces said ultra hard material layer to be substantially free of fractures, chips and cracks.

15. The method as in claim 1 during sintering the liner and at least a compound of the ultra hard material and the enclosure form a eutectic having a melting temperature in the range of about 1100° C. to about 1410° C.

16. The method as in claim 1, further comprising joining said ultra hard layer to a substrate to form a cutting element, and mounting said cutting element on a bit body.

17. The method as in claim 1, wherein said disposing a metallic liner within said enclosure comprises providing a strip of said metallic liner having opposed ends and spot welding said opposed ends to each other to produce an annular shape.

18. The method as in claim 1, wherein the liner is in the form selected from the group of forms consisting of foils, rings, tubes, pastes, coatings, sputterings, and slurries.

19. The method as in claim 1, wherein the liner forms a continuous peripheral layer around the entire periphery of the enclosure.

20. The method as in claim 1, wherein disposing comprises disposing a metallic liner having a melting temperature lower than the melting temperature of the enclosure.

21. The method as recited in claim 1 wherein the liner does not include carbide.

22. The method as recited in claim 1 wherein sintering converts said ultra hard material together with said liner to a solid ultra hard material layer.

23. A method for forming an ultra hard layer, comprising:
providing a refractory metal enclosure having an inner peripheral surface;
disposing a metallic liner within said enclosure;
placing ultra hard material within said enclosure, wherein at least a portion of said metallic liner is sandwiched between said ultra hard material and said inner peripheral surface;
placing a substrate material within said enclosure over the ultra hard material, wherein the substrate material is different from a material forming the liner; and
sintering to convert said ultra hard material to a solid ultra hard layer, wherein during sintering the liner forms a eutectic having a melting temperature and wherein the substrate forms a eutectic having a melting temperature, wherein the melting temperature of the liner formed eutectic is within 310° C. of the substrate formed eutectic.

24. The method as in claim 23 wherein during sintering, the liner and at least a compound of the ultra hard material form a eutectic having a melting temperature about the same as that of a eutectic of the substrate material.

25. The method as recited in claim 23 wherein the substrate comprises tungsten carbide.

26. The method as recited in claim 23 wherein a melting temperature of a eutectic formed during sintering between the liner, a compound of the ultra hard material, and the enclosure is in the range of about 1100° C. to about 1410° C.

27. The method as recited in claim 23 wherein the liner does not include carbide.

28. The method as in claim 23, wherein said metallic liner is formed of at least one of Fe, Co, and Ni.

29. A method for forming an ultra hard layer, comprising:

providing a refractory metal enclosure having an inner peripheral surface;

disposing a liner within said enclosure;

placing ultra hard material within said enclosure, wherein at least a portion of said liner is sandwiched between said ultra hard material and said inner peripheral surface;

sintering to convert said ultra hard material to a solid ultra hard layer, wherein during sintering the liner forms a plastically deformable region for preventing the formation of cracks on the ultra hard material adjacent said plastically deformable region during a cooling phase of said sintering; and removing said region.

30. The method as in claim 29 further comprising placing a substrate material within the enclosure, wherein said substrate material is a different from a material forming said liner, wherein during sintering, the liner, the enclosure and a compound of the ultra hard material form a eutectic having a melting temperature lower than a melting temperature of a eutectic of the substrate material.

31. The method as in claim 29 further comprising placing a substrate material within the enclosure, wherein during sintering, the liner, the enclosure and a compound of the ultra hard material form a eutectic having a melting temperature about the same as that of a eutectic of the substrate material.

32. The method as in claim 29 wherein during sintering, the liner, the enclosure and a compound of the ultra hard material form a eutectic having a melting temperature in the range of about 1100° C. to about 1410° C.

33. The method as recited in claim 29 wherein the liner does not include carbide.

34. A method for forming an ultra hard layer, comprising:

providing a refractory metal enclosure having an inner peripheral surface;

disposing a liner within said enclosure having a thickness in the range of 0.005 mm to 3 mm;

placing ultra hard material within said liner, wherein at least a portion of said liner is sandwiched between said ultra hard material and said peripheral surface;

sintering to convert said ultra hard material together with said liner to a solid ultra hard material layer, wherein during sintering a peripheral portion of said ultra hard material is infiltrated by a material forming said liner; and removing a majority of said peripheral portion.

* * * * *

UNITED STATES PATENT AND TRADEMARK OFFICE

CERTIFICATE OF CORRECTION

PATENT NO. : 7,368,079 B2
APPLICATION NO. : 10/731710
DATED : May 6, 2008
INVENTOR(S) : Xian Yao It is certified that error appears in the above-identified patent and that said Letters Patent is hereby corrected as shown below:

| | |
|---|---|
| Column 3, line 22 | Delete “an”,<br>Insert --a-- |
| Column 3, line 29 | After “exemplary”,<br>Delete “.” |
| Column 4, line 55 | Delete “posses”,<br>Insert --possess-- |
| Column 5, line 8 | Delete “a”,<br>Insert --an-- |
| Column 5, line 10 | Delete “a”,<br>Insert --an-- |
| Column 5, line 18 | Delete “in a”,<br>Insert --in an-- |
| Column 6, line 15 | Delete “then”,<br>Insert --than-- |

UNITED STATES PATENT AND TRADEMARK OFFICE

CERTIFICATE OF CORRECTION

PATENT NO. : 7,368,079 B2
APPLICATION NO. : 10/731710
DATED : May 6, 2008
INVENTOR(S) : Xian Yao It is certified that error appears in the above-identified patent and that said Letters Patent is hereby corrected as shown below:

In the Claims

| | |
|---|---|
| Column 8, line 8, Claim 9 | After "eutectic",<br>Insert --of-- |
| Column 10, line 1, Claim 30 | After "is",<br>Delete "a" |

Signed and Sealed this

Seventh Day of October, 2008

JON W. DUDAS
*Director of the United States Patent and Trademark Office*